United States Patent [19]

Oaku et al.

[11] Patent Number: 4,556,533

[45] Date of Patent: Dec. 3, 1985

[54] WEAR-RESISTANT SINTERED FERROUS ALLOY AND METHOD OF PRODUCING SAME

[75] Inventors: Takaaki Oaku, Yokosuka; Masahiko Shioda, Yokohama; Syunsuke Suzuki, Tokyo; Yoshihiro Maki, Miura, all of Japan

[73] Assignee: Nissan Motor Co., Ltd., Yokohama, Japan

[21] Appl. No.: 556,605

[22] Filed: Nov. 30, 1983

[30] Foreign Application Priority Data

Dec. 2, 1982 [JP] Japan ..... 57-211962

[51] Int. Cl.[4] ..... B22F 3/16

[52] U.S. Cl. ..... 419/11; 419/12; 419/32; 419/38; 419/57; 75/123 CB; 75/123 B; 75/123 D; 75/123 L; 75/126 A; 75/126 P; 75/126 K; 75/126 Q; 75/130 R; 75/130.5; 75/132

[58] Field of Search ..... 75/123 CB, 123 B, 123 D, 75/123 L, 126 A, 126 P, 126 K, 126 Q, 130 R, 130.5, 132; 419/11, 12, 32, 38, 57

[56] References Cited

U.S. PATENT DOCUMENTS 3,977,838 8/1976 Hashimoto et al. ..... 29/182.5
4,243,414 1/1981 Takahashi et al. ..... 75/244
4,344,795 8/1982 Endo et al. ..... 75/230
4,491,477 1/1985 Suganuma et al. ..... 75/230
4,504,312 3/1985 Oaku et al. ..... 75/244

FOREIGN PATENT DOCUMENTS 55-145157 11/1980 Japan .
57-9858 1/1982 Japan .

*Primary Examiner*—Stephen J. Lechert, Jr.
*Attorney, Agent, or Firm*—Schwartz, Jeffery, Schwaab, Mack, Blumenthal & Evans

[57] ABSTRACT

A sintered ferrous alloy which is high in wear resistance and relatively weak in the tendency to abrade another metal material with which the sintered alloy makes rubbing contact. The sintered alloy is produced by compacting and sintering 100 parts by weight of a powder mixture of 5–35 parts by weight of a Fe-Cr-B-Si alloy powder, which contains 10–35% of Cr, 1.0–2.5% of B and 0.5–3.0% of Si, such an amount of a Cu-P alloy powder that the powder mixture contains 0.2–1.5% of P and 1.0 to 20.0% of Cu, and the balance of a cast iron powder. Preferably the cast iron powder contains 2.5–3.5% of C, 1.8–2.2% of Si and 0.6–1.0% of Mn. For example, the sintered alloy is suitable for rocker arm tips in automotive engines.

3 Claims, No Drawings

WEAR-RESISTANT SINTERED FERROUS ALLOY AND METHOD OF PRODUCING SAME

BACKGROUND OF THE INVENTION

This invention relates to a wear-resistant sintered ferrous alloy useful for machine parts subjected to rubbing friction and a method of producing the same.

A typical example of metal parts that are forced to make continuous rubbing contact with another metal part is the rocker arm of an internal combustion engine. Usually the body of the rocker arm is formed by casting or forging, but the tip part where the rocker arm makes rubbing contact with a cam must be afforded with higher wear resistance. Therefore, it is usual to harden the tip portion of the rocker arm by a surface treatment such as carbrizing, nitriding or chromium plating, or alternatively to form the tip part separately from the main part of the rocker arm by chilled casting or by a powder metallurgy method and attach the tip part to the rocker arm body by soldering or by insert-casting.

As the performance requirements to the recent internal combustion engines for automotive uses have become more and more severe, there is the tendency to force the rocker arms to make rubbing contact with the cams under increased pressures. Then there arises a problem that the supply of lubricating oil into the interface between the cam surface and the rocker arm tip becomes insufficient while the cam rotation rate is low and hence the sliding speed of the rocker arm relative to the cam surface is low as occurs during idling or very low speed operation of the engine. The insufficiency in lubrication often results in serious wear or scuffing of the rocker arm tip made of a usual material.

It is possible to use a sintered porous alloy that is impregnated with oil to acquire a self-lubricating property and high resistance to wear. In that case, however, the sintered alloy contains relatively large amounts of special and costly metals such as W and/or Mo in order to possess such a high hardness as is sufficient for use in parts subjected to severe rubbing or friction. If the contents of such costly metals are decreased to reduce the cost of the sintered alloy, then it becomes necessary to subject the sintered alloy parts to a hardening treatment such as a heat treatment or a certain surface treatment whereby the production of the sintered alloy parts becomes complicated with inevitable rise in the production cost. As another problem, the use of rocker arm tips made of a known sintered alloy which is highly resistant to wear often results in serious abrasion of the cams in sliding contact with the rocker arm tips.

SUMMARY OF THE INVENTION

It is an object of the present invention to provide a sintered alloy which has such high wear resistance as is sufficient for machine parts subjected to severe rubbing friction such as the rocker arm tips in recent automotive internal combustion engines but is relatively weak in the tendency to abrade another metal material brought into rubbing contact with the sintered alloy parts.

It is another object of the invention to provide a sintered alloy which is very high in wear resistance and can be produced at relatively low costs.

It is still another object of the invention to provide a method of producing a sintered alloy according to the invention.

The present invention provides a method of producing a wear-resistant sintered ferrous alloy, the method comprising the steps of preparing 100 parts by weight of a powder mixture by mixing 5 to 35 parts by weight of a powder of a Fe-Cr-B-Si alloy which contains 10 to 35% by weight of Cr, 1.0 to 2.5% by weight of B and 0.5 to 3.0% by weight of Si, such an amount of a Cu-P alloy powder that the prepared powder mixture contains 0.2 to 1.5% by weight of P and 1.0 to 20.0% by weight of Cu, and the balance of a powder of a cast iron such that the powder mixture contains 1.0 to 2.5% by weight of Si and 1.0 to 3.5% by weight of C, compacting the powder mixture into a body of a desired shape, and sintering the compacted body in a nonoxidizing atmosphere.

Preferably use is made of a Cu-P alloy containing 8 to 15% by weight of P, and it is also preferred to use a cast iron containing 2.5 to 3.5% by weight of C, 1.8 to 2.2% by weight of Si and 0.6 to 1.0% by weight of Mn.

As the product of the above stated method, a wear-resistant sintered ferrous alloy according to the invention consists essentially of 0.5 to 12.5% of Cr, 0.05 to 0.90% of B, 1.0 to 2.5% of Si, 1.0 to 3.5% of C, 0.2 to 1.5% of P, 1.0 to 20.0% of Cu, all by weight, and the balance of Fe.

A wear-resistant sintered alloy of the invention has a Fe-C base matrix which is principally sorbite or bainite and may partly be pearlite, and hard phases of carbides including Fe-P-C and borides in particulate form, free carbon in the form of graphite and elemental copper are uniformly dispersed in the matrix. Preferably the matrix exhibits a hardness number of about 300–600 mHv (measured by Vickers microhardness method), and the particulate hard phases are about 10–100 $\mu$m in mean particle size, about 900–1300 mHv in hardness and amount to about 10–50% by surface area in any section of the sintered alloy.

A sintered alloy of the invention is very high in wear resistance but relatively weak in the tendency to abrade another metal material with which the sintered alloy makes rubbing contact. That is, this sintered alloy is superior to other wear-resistant sintered ferrous alloys in fitting property or physical affinity for different metal materials. Accordingly, when this sintered alloy is used for rocker arm tips in the recent automotive internal combustion engines both the rocker arm tips and the cam faces become very small in the amounts of wear. This sintered alloy does not use very costly metals such as Mo and W, and can easily be produced by using conventional powder metallurgy techniques. Besides, an ordinary cast iron powder obtained as chips in machining operations can be used as a basic and major material for this sintered alloy. Accordingly this excellent sintered alloy can be produced at very low cost. In principle, machine parts formed of this sintered alloy can be used in the state as sintered without the need of any post-sintering heat treatment or surface treatment.

An important feature of the invention is the use of a Cu-P alloy powder in combination with a Fe-Cr-B-Si alloy powder and a cast iron powder.

At the sintering step in the method of the invention, the Cu-P alloy powder provides a liquid phase at a relatively low temperature so that the sintering can smoothly be achieved without the need of employing an undesirably high sintering temperature. As a favorable effect of a relatively low sintering temperature, carbon contained in the cast iron powder does not unnecessarily largely combine with the elements of the Fe-Cr-B-Si alloy powder so that the amount of free carbon or graphite dispersed in the matrix of the sintered alloy becomes considerably larger than in resembling but different sintered alloys. During the sintering, P contained in the aforementioned liquid phase readily reacts with Fe and Fe-C of the cast iron powder to form carbides including a Fe-P-C system or steadite which assumes a liquid state during the sintering process and becomes a hard phase in the sintered alloy. Because of a resultant decrease of P in the molten Cu-P alloy, a portion of Cu contained in the initial Cu-P alloy powder is isolated from the alloy and subsequently solidifies in the elemental form. Consequently the sintered alloy contains free copper together with free graphite and, therefore, has an improved fitting property or physical affinity for other metal materials. Accordingly the rocker arm tip formed of this sintered alloy is weak in the tendency to abrade the cam despite its excellent wear resistance.

Prior to the completion of the present invention, it was tried to use Fe-P powder in place of the Cu-P alloy powder in the present invention. A resultant sintered ferrous alloy is excellent in wear resistance but involves some problems. The Fe-P alloy powder has the effect of producing a liquid phase of Fe-P-C system during the sintering process and thereby promoting sintering. However, the temperature sufficient to produce such a liquid phase is higher than the temperature sufficient to melt a Cu-P alloy powder. Furthermore, sometimes an undesirably large amount of hard steadite phase in intricate shape appears in the sintered alloy as a result of slight variations in the amount of the Fe-P alloy powder and/or the sintering temperature. In such cases the sintered alloy used as the rocker arm tip becomes relatively strong in the tendency to abrade the cam. Compared with the sintered alloy of the invention, the sintered alloy obtained by using a Fe-P alloy powder is smaller in the amount of free graphite dispersed in the matrix and, therefore, inferior in the lubricating property when used for sliding machine parts which are operated under severe friction conditions. Besides, the sintered alloy obtained by using Fe-P alloy powder needs to be impregnated with oil when the alloy is desired to exhibit very good physical affinity for another metal material since the sintered alloy does not contain Cu or any other soft metal that contributes to the improvement on the physical affinity.

In the method of the invention the sintering temperature can be made lower than in the case of using Fe-P powder by reason of a lower melting point of the Cu-P alloy powder, and therefore it is possible to accomplish sintering with a decrease in the amount of liquid phase of steadite or, in other words, without resulting in that the sintered alloy contains an excessively large amount of hard steadite phase which is liable to cause significant wear of a metal material that makes rubbing contact with the sintered alloy.

DESCRIPTION OF THE PREFERRED EMBODIMENTS

Throughout the following description, the amounts of the elements in the respective alloys are given in percentages by weight.

In the present invention a Fe-Cr-B-Si alloy powder is used as the source of Cr and B on which the wear resistance of the sintered alloy primarily depends. In the process of sintering the compacted powder material, the Fe-Cr-B-Si alloy powder mostly reacts with the cast iron powder by the aid of the aforementioned liquid phases to form carbides and borides which become particulate hard phases dispersed in the iron base matrix of the sintered alloy. The contents of Cr, B and Si in the Fe-Cr-B-Si alloy are respectively limited within the ranges noted hereinbefore for the following reasons.

Cr combines with B contained in the same alloy and also with Fe and C of the cast iron powder to form borides of Cr and/or Fe-Cr and carbides of Cr and/or Fe-Cr which precipitate out over the iron base matrix of the sintered alloy. Accordingly it is important that the amount of Cr in the powder mixture be balanced with the amounts of B and C. When the content of Cr in the Fe-Cr-B-Si alloy is less than 10% it is difficult to produce a sintered alloy in which the content of Cr is sufficient to afford desirably high wear resistance to the sintered alloy. However, Fe-Cr-B-Si alloy containing more than 35% of Cr is too high in the hardness of the alloy powder particles so that the alloy powder is inferior in formability.

As mentioned above, B combines with Cr and Fe to form hard borides. When the content of B in the Fe-Cr-B-Si alloy is less than 1.0% the total amount of the formed borides remains insufficient. When the content of B exceeds 2.5% the amount of the formed borides becomes more than sufficient, and the particles of the precipitated borides tend to become undesirably coarse and, besides, the alloy powder becomes inferior in formability.

Usually Fe-Cr-B-Si alloy powders are produced by an atomizing method. Si has the effect of improving the fluidity of the molten alloy in the production of the alloy powder and, besides, serves as a deoxidizing agent. When the content of Si in the Fe-Cr-B-Si alloy is less than 0.5% the expected effects of Si are hardly appreciable, but it is undesirable to increase the Si content beyond 3.0% because it is liable to cause lowering of the hardenability of the sintered alloy.

A powder mixture to be compacted and sintered is prepared so as to contain 5 to 35% by weight of Fe-Cr-B-Si alloy powder. When the amount of the Fe-Cr-B-Si alloy powder is less than 5%, the amounts of the hard phases of borides and carbides in the sintered alloy remain insufficient to afford desirably high wear resistance to the sintered alloy. However, an increase in the amount of the Fe-Cr-B-Si alloy powder in the powder mixture beyond 35% no longer produces a corresponding effect on the wear resistance of the sintered alloy and, besides, renders the formability of the powder mixture inferior. Furthermore, such an increase in the amount of the Fe-Cr-B-Si alloy powder will cause such a decrease in the amount of the cast iron powder that the powder composition does not contain a sufficient amount of C and, therefore, results in that free carbon or graphite scarcely exists in the sintered alloy. In this regard, the content of C in the employed cast iron powder should also be taken into consideration in determining the amount of the Fe-Cr-B-Si alloy powder in the powder composition. To ensure the presence of free graphite in the matrix of the sintered alloy, it is desirable to determine the amount of the Fe-Cr-B-Si alloy powder such that the powder composition contains at least 2.4% by weight of C. If the content of C in the cast iron powder is insufficient, it is permissible to add an adequate amount of graphite powder to the powder composition so as to compensate for the shortage of the carbon content.

In the sintered alloy of the invention produced by using a powder mixture containing 5–35% of a Fe-Cr- B-Si alloy which contains the above described amounts of Cr, B and Si, the content of Cr is 0.5–12.25% and the content of B is 0.05–0.875% by calculation. The content of Si in the sintered alloy becomes 0.025–0.105% by calculation if the Fe-Cr-B-Si alloy alone were considered as the source of Si, but actually the cast iron powder too contains Si. Considering both the Fe-Cr-B-Si alloy powder and the cast iron powder as the soruces of Si, the Si content in the sintered alloy is specified to be 1.0–2.5%.

In the present invention a Cu-P alloy powder is used as an essential material for the purposes described hereinbefore. Instead of adding Cu and P to the powder mixture separately, use is made of a Cu-P alloy powder with the intention of realizing very intimate contact between Cu and P thereby ensuring that the expected liquid phase is produced in a sufficient quantity at relatively low temperatures and also with a view to minimizing evaporation loss of P during the sintering process.

The amount of the Cu-P powder in the powder composition is carefully determined, so that the sintered alloy contains a sufficient amount of elemental Cu dispersed in the alloy matrix as a sort of lubricating component which contributes to improved physical affinity of the sintered alloy as well as the free graphite and an adequate amount of P as a constituent of steadite which contributes to the wear resistance of the sintered alloy jointly with the other carbides and borides. More particularly, the amount of the Cu-P alloy powder is controlled such that the prepared powder composition contains 0.2 to 1.5% by weight of P and 1.0 to 20.0% by weight of Cu. When the content of P in the powder composition to be sintered is less than 0.2% the expected effects of P remain insufficient. However, it is undesirable to increase the content of P beyond 1.5% firstly because an excessively large quantity of steadite liquid phase is produced in the sintering process to result in that the sintered alloy has coarse surfaces and is unsatisfactory in the dimensional precision, and secondly because there occurs extraordinary growth of hard steadite phase so that the sintered alloy becomes inferior in the smoothness of its rubbing or sliding contact with another metal material. As to the proportion of P to Cu in the sintered alloy, it is suitable to use a Cu-P alloy powder which contains 8 to 15% by weight of P and is commercially available.

A cast iron powder is used as a primary raw material for a sintered ferrous alloy of the invention. It is possible to obtain a suitable powder by pulverizing chips produced in machining of cast iron parts. It is preferred to use a cast iron which consists essentially of 2.5–3.5% of C, 1.8–2.2% of Si, 0.6–1.0% of Mn and the balance of Fe, permitting the existence of small amounts of usual impurity elements. The cast iron powder provides substantially the entire amount of C as an essential element of the sintered ferrous alloy. In selecting a cast iron powder and preparing the starting powder mixture, attention should be paid to obtain a powder mixture containing 1.0–3.5%, and preferably 2.4–3.5%, by weight of C.

A powder composition prepared in the above described manner is compacted into a desired shape by a conventional compacting method. Preferably the compaction is performed by application of a compression pressure of about 5000–8000 kg/cm$^2$.

The compacted material is subjected to sintering. It is preferred to perform the sintering in vacuum, but it is also possible to perform the sintering in either a reducing gas atmosphere or an unreactive gas atmosphere on condition that the sintering atmosphere is practically free of oxygen and moisture.

The sintering temperature should be determined carefully. If the sintering temperature is too low it is difficult to realize good dispersion of the Fe-Cr-B-Si alloy in the iron matrix and, furthermore, the particles of the powder composition do not strongly bond to one another. When the sintering temperature is too high it becomes difficult to leave a sufficient amount of free carbon in the sintered alloy matrix because the reactivity of carbon during sintering becomes too high. From consideration of various factors it is preferred to perform the sintering within the temperature range from about 950° C. to about 1100° C. By employing a sintering temperature within this range, usually it is suitable to carry out sintering for about 30 to 60 min.

As to the porosity of the sintered alloy products, the existence of some pores raises no problem and is rather favorable for practical use because of the possibility of augmenting the self-lubricating property of the sintered products by impregnation with oil. However, an unduly high porosity weakens the mechanical strength of the sintered products. Therefore, it is suitable that the porosity of the sintered alloy does not exceed about 20%.

A sintered alloy according to the invention is inherently excellent in wear resistance, so that in principle the rocker arm tips or other machine parts formed of this sintered alloy can be used without need of any post-sintering treatment such as heat treatment or surface treatment. However, it is possible and optional to further enhance the wear resistance of the sintered parts by making a heat treatment such as quenching and tempering or a surface treatment such as nitriding insofar as the enhanced hardness of the sintered parts is not significantly unfavorable to the durability of the materials subjected to rubbing contact with the sintered alloy parts.

The invention will further be illustrated by the following nonlimitative examples.

EXAMPLE 1

Use was made of a cast iron powder which was obtained by pulverizing chips produced in machining of a gray cast iron (JIS FC25) containing about 3.3% of C, about 1.7% of Si and about 0.6% of Mn. The cast iron powder consisted of particles that passed through a 60-mesh sieve and retained on a 320-mesh sieve. A powder mixture was prepared by mixing 85 parts by weight of the cast iron powder, 10 parts by weight of a Fe-Cr-B-Si alloy powder (passed through a 100-mesh sieve) containing 20% of Cr, 1.5% of B and 0.8% of Si and 5 parts by weight of a Cu-P alloy powder (passed through a 100-mesh sieve) containing 15% of P. After the addition of zinc stearate amounting to 0.75% by weight of the metal powder mixture, thorough mixing was performed for 15 min in a V-shaped blender.

Table 1 shows the composition of the thus prepared powder mixture together with the corresponding data in the subsequent examples.

The powder mixture was compacted into the shape of a rocker arm tip for an automotive internal combustion engine by application of a pressure of 8000 kg/cm$^2$, and the compacted body was sintered in vacuum ($10^{-3}$ Torr) at 1050° C. for 45 min to obtain a rocker arm tip formed of a sintered alloy which had a porosity of 5–10%.

TABLE 1

| | Contents of Alloying Elements (Wt %) | | | | | | |
|---|---|---|---|---|---|---|---|
| | Cr | B | Si | P | Cu | C | Mn |
| Example 1 | 2.0 | 0.15 | 1.53 | 0.75 | 4.25 | 2.8 | 0.5 |
| Example 2 | 2.25 | 0.30 | 2.05 | 1.05 | 5.95 | 2.7 | 0.4 |
| Example 3 | 5.0 | 0.25 | 2.00 | 0.45 | 2.55 | 3.0 | 0.35 |
| Example 4 | 3.0 | 0.10 | 1.50 | 0.56 | 6.44 | 2.7 | 0.5 |

EXAMPLE 2

Use was made of a cast iron powder which was obtained by pulverizing chips produced in machining of a gray cast iron (JIS FC15) containing about 3.5% of C, about 2.5% of Si and about 0.5% of Mn. The cast iron powder consisted of particles that passed through a 60-mesh sieve and retained on a 320-mesh sieve. A powder mixture was prepared by mixing 78 parts by weight of the cast iron powder, 15 parts by weight of a Fe-Cr-B-Si alloy powder (passed through a 100-mesh sieve) containing 15% of Cr, 2.0% of B and 0.9% of Si and 7 parts by weight of the aforementioned Cu-P alloy powder containing 15% of P. After the addition of zinc stearate amounting to 0.75% by weight of the metal powder mixture, thorough mixing was performed for 15 min in a V-shaped blender.

The powder mixture was compacted into the shape of the rocker arm tip by application of a pressure of 8000 kg/cm$^2$, and the compacted body was sintered in vacuum ($10^{-3}$ Torr) at 1020° C. for 30 min to obtain a rocker arm tip formed of a sintered alloy which had a porosity of 5–10%.

EXAMPLE 3

Use was made of a cast iron powder which was obtained by pulverizing chips produced in machining of a spheroidal graphite cast iron (JIS FCD 40) containing about 4.2% of C, about 2.5% of Si and about 1.0% of Mn. The cast iron powder consisted of particles that passed through a 60-mesh sieve and retained on a 320-mesh sieve. A powder mixture was prepared by mixing 72 parts by weight of the cast iron powder, 25 parts by weight of a Fe-Cr-B-Si alloy powder (passed through a 100-mesh sieve) containing 20% of Cr, 1.0% of B and 0.8% of Si and 3.0 parts by weight of the Cu-P alloy powder used in Examples 1 and 2 (containing 15% of P). After the addition of zinc stearate amounting to 0.75% by weight of the metal powder mixture, thorough mixing was performed for 15 min in a V-shaped blender.

The powder mixture was compacted into the shape of the rocker arm tip by application of a pressure of 8000 kg/cm$^2$, and the compacted body was sintered in vacuum ($10^{-3}$ Torr) at 1080° C. for 30 min to obtain a rocker arm tip formed of a sintered alloy which had a porosity of 5–10%.

EXAMPLE 4

A powder mixture was prepared by mixing 83 parts by weight of the gray cast iron powder used in Example 1, 10 parts by weight of a Fe-Cr-B-Si alloy powder (passed through a 100-mesh sieve) containing 30% of Cr, 1.0% of B and 0.9% of Si and 7 parts by weight of a Cu-P alloy powder (passed through a 100-mesh sieve) containing 7% of P. After the addition of zinc stearate amounting to 0.75% by weight of the metal powder mixture, thorough mixing was performed for 15 min in a V-shaped blender.

The powder mixture was compacted into the shape of the rocker arm tip by application of a pressure of 6000 kg/cm$^2$, and the compacted body was sintered in vacuum ($10^{-3}$ Torr) at 1060° C. for 45 min to obtain a rocker arm tip formed of a sintered alloy which had a porosity of 10–15%.

Endurance Test

The sintered rocker arm tips produced in Examples 1–4 were individually attached to rocker arms, which were used in a 1.8-liter in-line four-cylinder gasoline engine of the overhead camshaft type. The cams with which the rocker arm tips made rubbing contact were produced by chilled casting. The engine was operated over a period of 400 hr to examine the wear resistance and durability of the respective rocker arm tips and cams. To accelerate the wear, the engine was operated with augmented force of the valve spring and with addition of water to the lubricating oil.

| | |
|---|---|
| Revolutions of Engine | 650 rpm |
| Lubricating Oil | SAE 20W 40 |
| Lubricating Oil Temperature | 90–100° C. |
| Water Added to Lubricating Oil | 2 Wt % |
| Force of Valve Spring | 86 kg |

The results of the endurance test are presented in the following Table 2 together with the corresponding data obtained by testing the comparative rocker arm tips produced in the reference experiments described below.

REFERENCE 1

A powder of a ferrous alloy consisting essentially of 4% of Cr, 4% of Mo, 6% of W, 2% of V, 0.9% of C and the balance of Fe was compacted into the shape of the rocker arm tip by application of a pressure of 6000 kg/cm$^2$, and the compacted body was sintered in vacuum at 1200° C. for 1 hr. Then the porosity of the sintered body was adjusted to 9% by reheating and recompression. After that the sintered body was heated to 1200° C. for quench-hardening and tempered at 550° C. for 1 hr. This process was repeated once more to finish a sintered rocker arm tip.

REFERENCE 2

A powder mixture was prepared by mixing 85 parts by weight of the gray cast iron powder used in Example 1 with 15 parts by weight of the Fe-Cr-B-Si alloy powder used in Example 1. After the addition of zinc stearate amounting to 0.75% by weight of the metal powder mixture, thorough mixing was performed for 15 min in a V-shaped blender.

The powder mixture was compacted into the shape of the rocker arm tip by application of a pressure of 8000 kg/cm$^2$, and the compacted body was sintered in vacuum ($10^{-3}$ Torr) at 1125° C. for 45 min to obtain a rocker arm tip formed of a sintered alloy which had a porosity of 8–15%.

In the sintered alloy of Reference 2 the contents of Cr, B and Si were respectively within the ranges specified by the present invention, but neither P nor Cu was contained in this sintered alloy.

REFERENCE 3

A powder mixture was prepared by mixing 58 parts by weight of the gray cast iron powder used in Example 1, 40 parts by weight of the Fe-Cr-B-Si alloy powder used in Example 3 and 2 parts by weight of a Fe-P alloy powder containing 27% of P. After the addition of zinc stearate amounting to 0.75% by weight of the metal powder mixture, thorough mixing was performed for 15 min in a V-shaped blender.

The powder mixture was compacted into the shape of the rocker arm tip by application of a pressure of 8000 kg/cm$^2$, and the compacted body was sintered in vacuum ($10^{-3}$ Torr) at 1080° C. for 30 min to obtain a rocker arm tip formed of a sintered alloy.

The sintered alloy of Reference 3 contained Cr, B, Si and P respectively in such amounts as specified by the present invention, but this alloy did not contain Cu since the Fe-P alloy powder was used in place of the Cu-P alloy powders in Examples 1–4.

REFERENCE 4

A powder mixture ws prepared by mixing 83 parts by weight of the gray cast iron powder used in Example 2, 15 parts by weight of the Fe-Cr-B-Si alloy powder used in Example 2 and 2 parts by weight of the Fe-P alloy powder used in Reference 3, followed by the addition of zinc stearate and thorough mixing in the same manner as in Reference 3.

The powder mixture was compacted into the shape of the rocker arm tip by application of a pressure of 8000 kg/cm$^2$, and the compacted body was sintered in vacuum ($10^{-3}$ Torr) at 1080° C. for 30 min to obtain a rocker arm tip formed of a sintered alloy which had a porosity of 5–10%.

The sintered alloy of Reference 4 contained Cr, B, Si and P respectively in such amounts as specified by the present invention, but this alloy did not contain Cu since the Fe-P alloy powder was used in place of a Cu-P alloy powder.

TABLE 2

| | Results of Endurance Test | |
|---|---|---|
| Sample | Amount of Wear of Rocker Arm Tip (μm) | Amount of Wear of Cam (μm) |
| Example 1 | 10–18 | 10–16 |
| Example 2 | 8–12 | 12–20 |
| Example 3 | 12–20 | 6–12 |

TABLE 2-continued

| | Results of Endurance Test | |
|---|---|---|
| Sample | Amount of Wear of Rocker Arm Tip (μm) | Amount of Wear of Cam (μm) |
| Example 4 | 10–16 | 10–22 |
| Reference 1 | 150–180 | 30–65 |
| Reference 2 | 25–40 | 23–40 |
| Reference 3 | 30–50 | 20–28 |
| Reference 4 | 12–20 | 10–22 |

As can be seen in Table 2, the sintered alloy rocker arm tips produced in Examples 1–4 were all excellent in wear resistance and very low in the tendency to abrade the cams and can be judged to be superior to the samples of References 1–4. The test results can be taken as to demonstrate favorable effects of the presence of Cu and an increased amount of free carbon in the alloy matrix on the physical affinity of a sintered alloy according to the invention for another metal material with which the sintered alloy is brought into sliding contact.

What is claimed is:

1. A method of producing a wear-resistant sintered ferrous alloy, comprising the steps of:

(i) preparing 100 parts by weight of a powder mixture by mixing (a) 5 to 35 parts by weight of a powder of a Fe-Cr-B-Si alloy which contains 10 to 35% by weight of Cr, 1.0 to 2.5% by weight of B and 0.5 to 3.0% by weight of Si, (b) such an amount of a Cu-P alloy powder that the prepared powder mixture contains 0.2 to 1.5% by weight of P and 1.0 to 20.0% by weight of Cu, and (c) the balance of a powder of a cast iron such that said powder mixture contains 1.0 to 2.5% weight of Si and 1.0 to 3.5% by weight of C;

(ii) compacting said powder mixture into a body of a desired shape; and (iii) sintering said body in a nonoxidizing atmosphere at a temperature in the range from about 950° C. to about 1100° C. to produce a wear-resistant ferrous alloy having a reduced tendency to abrade metals in frictional contact therewith.

2. A method according to claim 1, wherein said Cu-P alloy powder contains 8 to 15% by weight of P.

3. A method according to claim 1, wherein said cast iron consists essentially of 2.5 to 3.5% by weight of C, 1.8 to 2.2% by weight of Si, 0.6 to 1.0% by weight of Mn and the balance of Fe.

* * * * *